United States Patent [19]

Landgraf et al.

[11] 4,093,204

[45] June 6, 1978

[54] SHEET CUTTER, FOLDER AND STACKER

[75] Inventors: Glenn A. Landgraf; Fred H. Ebel, both of Boca Raton, Fla.

[73] Assignee: Irvin Industries, Inc., Greenwich, Conn.

[21] Appl. No.: 741,566

[22] Filed: Nov. 15, 1976

[51] Int. Cl.[2] ..... B41F 13/56

[52] U.S. Cl. ..... 270/21

[58] Field of Search ..... 270/21, 67, 80–85, 270/61; 93/21, 25, 26, 32, 34, 84 R, 84 FF; 223/1, 37

[56] References Cited

U.S. PATENT DOCUMENTS

| | | | |
|---|---|---|---|
| 2,268,036 | 12/1941 | Kahn | 270/81 |
| 3,462,138 | 8/1969 | Grantham | 270/67 |
| 3,467,370 | 9/1969 | Grantham | 270/85 |
| 3,754,489 | 8/1973 | Carver | 83/16 |
| 3,888,395 | 6/1975 | Burt | 270/21 |
| 3,994,209 | 11/1976 | Jacob | 93/34 |

*Primary Examiner*—Edgar S. Burr
*Assistant Examiner*—A. Heinz
*Attorney, Agent, or Firm*—Wolf, Greenfield & Sacks

[57] ABSTRACT

A sheet cutting, folding and stacking machine having in series a cradle for supporting the rolls of sheet material to be processed by the machine; a printer; a scray for temporarily storing the sheet material drawn from the roll before it is processed by the other assemblies of the machine; a hot wire cutter which cuts the sheet into sections of a selected length and seals the cut edges; a folder for quarter folding the cut section of the sheet; and a stacker assembly for taking the folded sections and stacking them on top of one another into bundles of a selected number.

9 Claims, 9 Drawing Figures

SHEET CUTTER, FOLDER AND STACKER

INTRODUCTION

This invention relates to cutting, folding and stacking machines and more particularly comprises a machine particularly designed to handle sheet material used for baling cotton.

There are a number of machines available at the present time which are capable of separately performing one or some of the functions performed by the machine of this invention. However, the machine of this invention is particularly efficient because it is capable of being manned by a single operator and the machine in sequence takes the material in roll form and without stopping produces a stack of folded sheets of a selected number. Moreover, when used in combination with other ancillary equipment, the stack may be bundled and packaged with other bundles, ready for shipment. The machine does not store or detain the sheets during any portion of the entire operation.

One important object of the present invention is to reduce the amount of handling required while performing the several operations of the machine.

Another important object of this invention is to provide a machine which may be run continuously around the clock and produce a very large number of bundles of folded sheets.

Another important object of this invention is to provide a machine capable of performing the cutting, folding, stacking and bundling operations and which is much less expensive than machines of the prior art and which may be operated with less supervision than the prior art machines.

Another important object of this invention is to provide a cutter in a cutting, folding and stacking machine, which not only serves to cut the sheet from the roll into selected lengths but in addition seals the cut edges so that they do not unravel.

To accomplish these and other objects, the machine of this invention includes in sequence a cradle for the sheet received in roll form, a printer which is designed to apply a logo or other indicia intermittently to the sheet at selected points along its lengths as the sheet is unwound from the roll, a scray which temporarily stores unrolled portions of the sheet while still connected as part of the roll, a hot wire cutter for cutting the sheet into sections of a selected length and simultaneously sealing the cut edges of the sections, a folder which is designed to quarter fold each section of sheet, and a stacker assembly which takes the folded sheets one at a time from the machine and stacks them on a platform. In the preferred form of this invention, the stacks are assembled on a scissor lift which may be intermittently lowered to accommodate the growing stack of folded sheets.

These and other objects and features of this invention will be better understood and appreciated from the following detailed description of one embodiment thereof, selected for purposes of illustration and shown in the accompanying drawings.

BRIEF FIGURE DESCRIPTION

DETAILED DESCRIPTION

As has been suggested in the introduction above, the machine of this invention is designed to receive large rolls of sheet material and in sequence it cuts the material into separate sheets of a selected size and at the time it cuts them it seals the cut ends of the sheets so that they do not unravel, folds the individual sheets, and stacks and counts the folded sheets. The sheets typically are intended to be used as a substitute for jute burlap material that is now used for baling cotton. In the following sections under appropriate headings each of the different stages of the machine is described.

UNROLLING CRADLE AND VARIABLE SPEED POWER SCRAY

Figure 1:
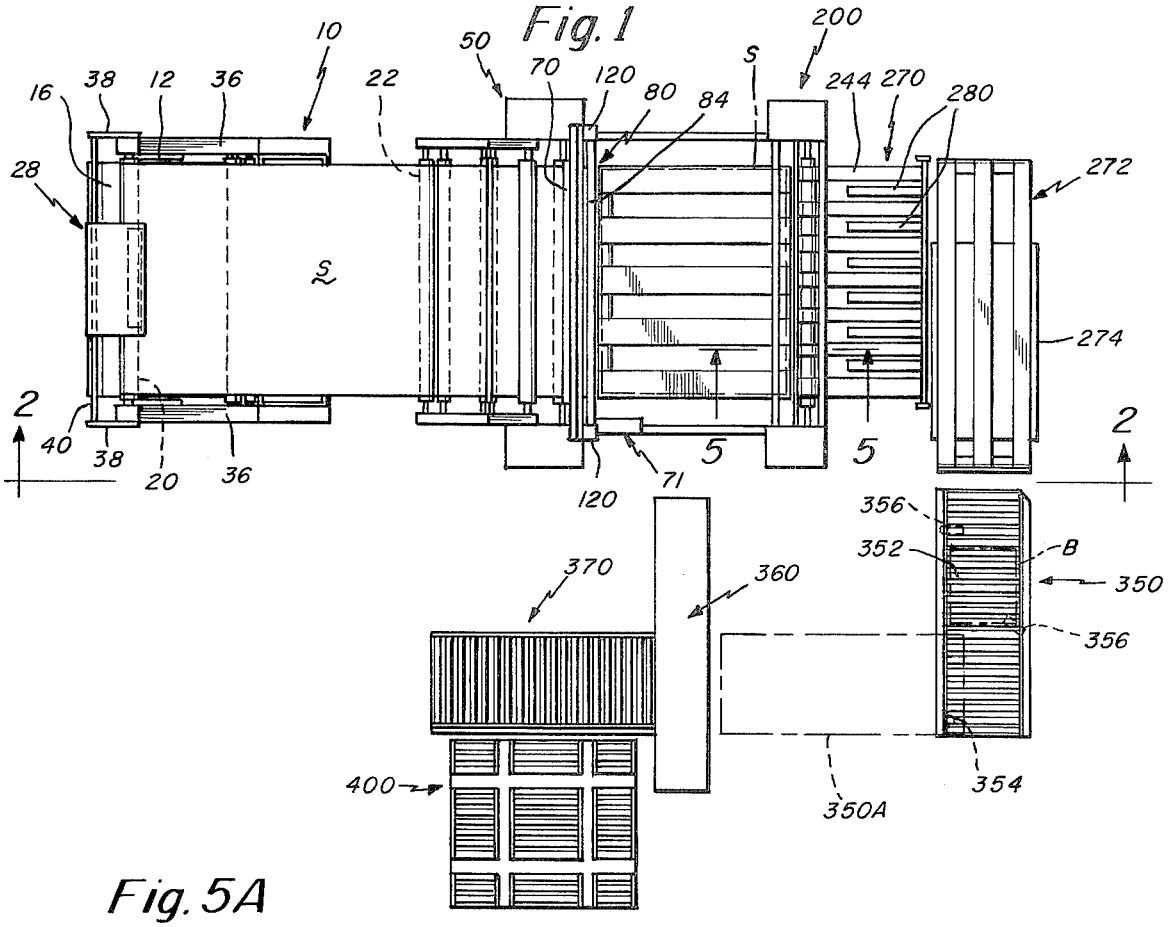
FIG. 1 is a plan view of a sheet cutter, folder and stacker machine constructed in accordance with this invention.
Figure 2:
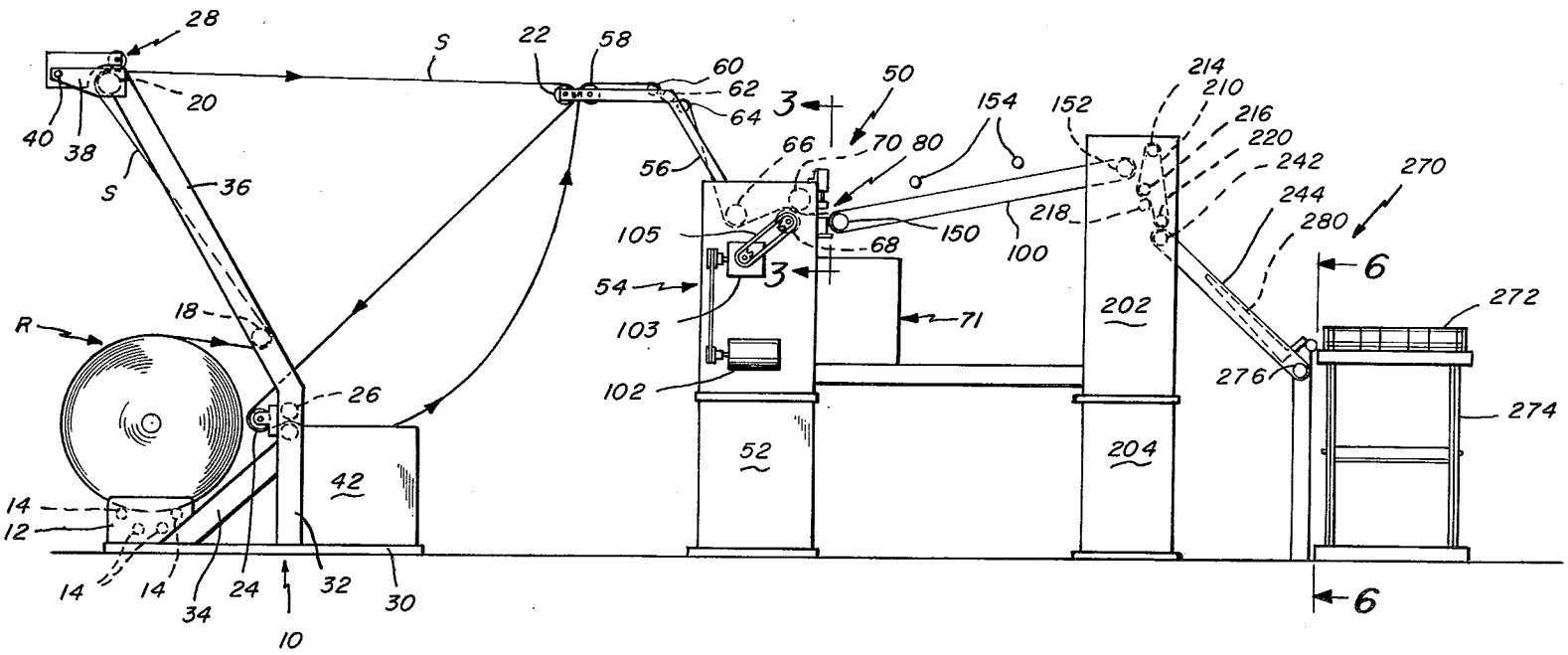
FIG. 2 is a side elevation view of a part of the machine viewed along sight line 2—2 of FIG. 1.

In FIGS. 1 and 2 the unrolling cradle and scray are generally designated at 10. In the embodiment illustrated a printer 28 is included in this assembly. The time required for the uncut sheet material to pass through printer 28 and then stack loosely in the screy before it is withdrawn for cutting enables the ink used for printing to dry. This assembly includes an unrolling cradle 12 having a number of idle rollers 14 which support the roll of sheet material R. The cradle permits the roll to be unrolled by drawing the material about a series of idle rolls 18, 20, 22 and 24 and between power driven pinch rollers 26. The uncut sheet material is shown in FIGS. 1 and 2 as it passes from the roll R through the scray at S. And the printer 28 which may be of standard design prints the logo on the uncut sheet. The printer may for example print an 8 inch logo on the material every 24 inches.

The frame of the cradle and scray 10 includes a base 30 and a pair of vertical posts 32, one on each side and braced by members 34. The posts 32 carrying extensions 36 between which idle rollers 18 and 20 extend. The printer 28 is mounted on post extensions 36 and includes a pair of end plates 38 welded to the tops of extensions 36. A shaft 40 extends between the plates 38 and in turn supports the printer 28. The printer is slidable on shaft 40 so as to enable the specific printing location to be selected at will.

The sheet material is drawn from the roll R by the pinch rollers 26 that under normal operating conditions are driven at a uniform speed by the motor. The scray collects the unrolled sheet material in the bin 42 and it is drawn intermittently from the bin by the rollers in the measuring assembly described hereafter.

MEASURING AND CUTTING ASSEMBLY

Figure 3:
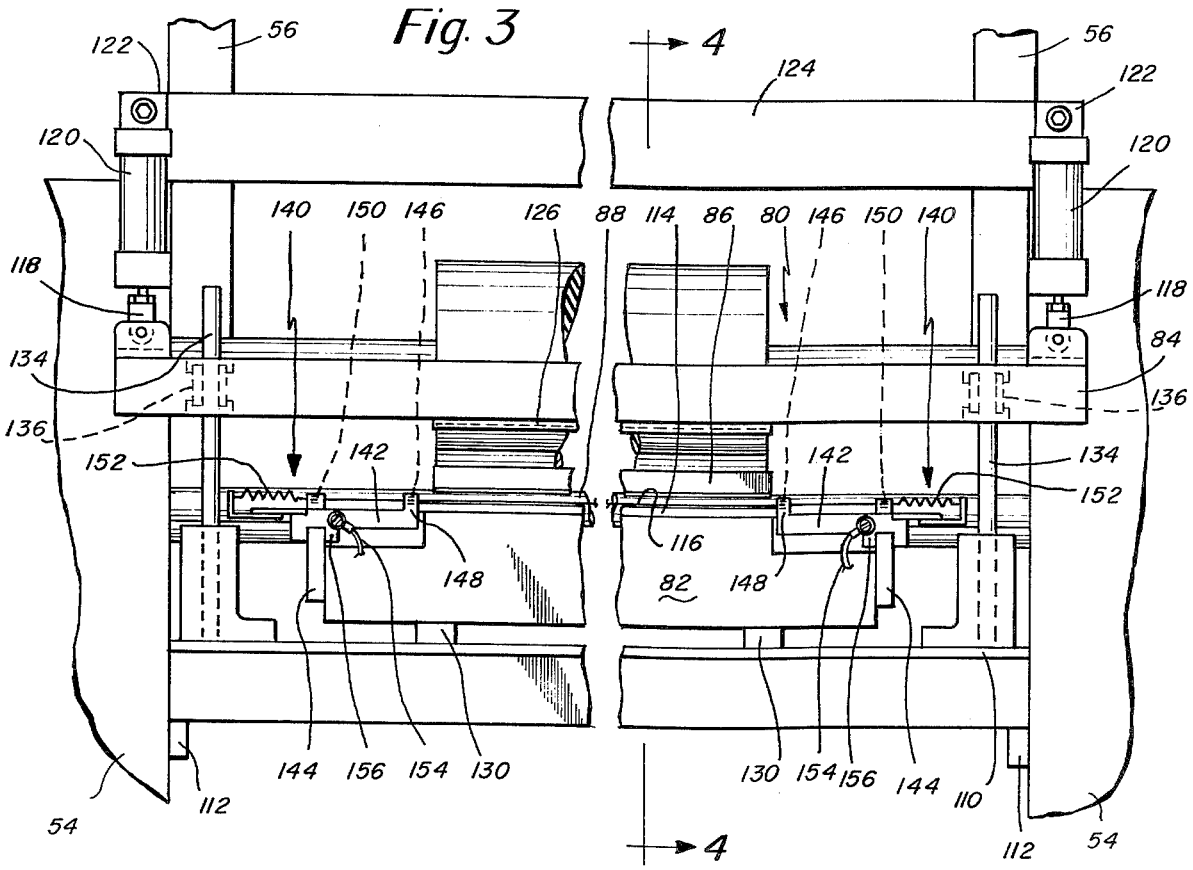
FIG. 3 is a fragmentary elevation view of the cutting assembly taken along section line 3—3 of FIG. 2.
Figure 4A:
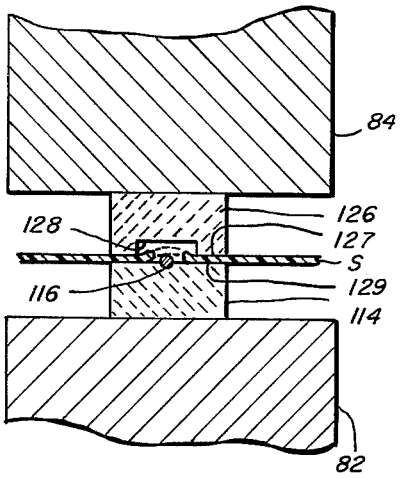
FIG. 4A is an enlarged fragmentary detail view of the cutter assembly.
Figure 4:
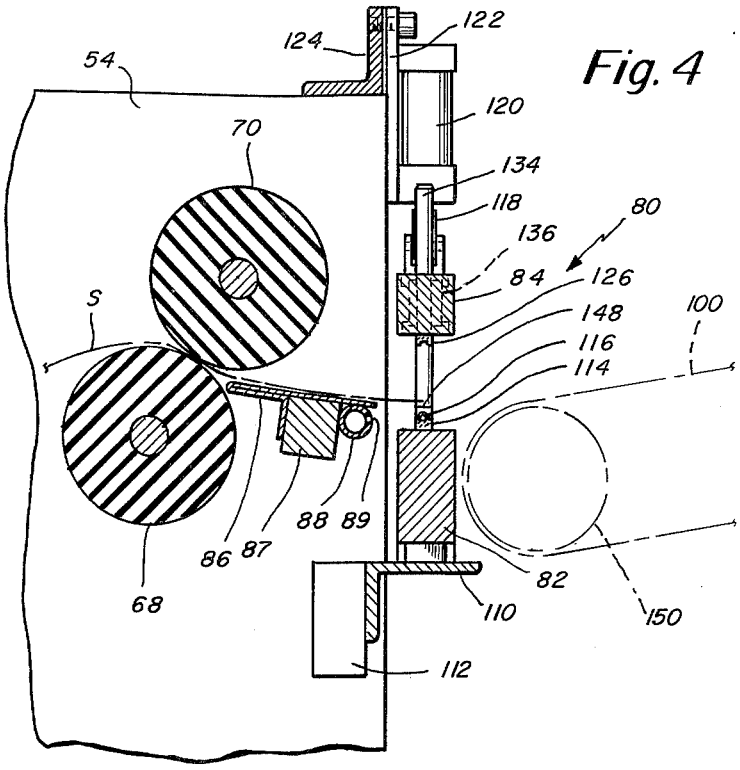
FIG. 4 is a fragmentary cross-section of the cutter assembly taken along section line 4—4 of FIG. 3.

The measuring assemby 50 measures the material S to selected lengths and cuts it by a hot wire cutter. The assembly is shown in FIGS. 3, 4 and 4A and includes a base 52 and frame member 54. Frame member 54 carries a pair of arms 56, one on each side of the machine, which in turn carry the idle roller 22 at their forward ends. The arms 56 also carry a second idle roller 58 over which extends the sheet material being drawn from the scray. The material S leaving the idle roller 58 intertwines with a series of three tension rollers 60, 62 and 64 as shown in FIG. 2 and then extends about roller 66 which also serves to tension the sheet S. The material after leaving the tension roller 66 extends through a pair of drive rollers 68 and 70.

The material is measured by counting the revolutions of the drive roller 68. By means of the control assembly 71, the details of which form no part of this invention, the length of material to be measured and cut may be selected by setting an appropriate dial (not shown) for a selected number of revolutions of the roller. Obviously the measurement is determined as a direct function of the revolutions.

At the measuring station the sheet material is cut into the preselected lengths. The cutting assembly is shown in FIGS. 3, 4 and 4A just downstream of the drive rollers 68 and 70. The cutting assembly is identified by reference character 80. The cutter is a hot wire cutter mounted on a pair of blocks 82 and 84 which are shown in detail in FIGS. 4 and 4A. In FIG. 4 a transfer plate 86 is shown disposed immediately adjacent to the drive rollers 68 and 70 to pick up the leading edge of the material as it emerges from between the rollers. A blow pipe 88 is disposed adjacent the downstream side of the plate 86 and elevates the material on the plate so as to carry it onto the fold approach belt 100 and between the blocks 82 and 84 of the hot wire cutter assembly 80. The transfer plate 86 is carried on the cross member 87 that extends between the sides of the frame 54. The blow pipe 88 has ports 89 which blow the material into the position suggested. The blow pipe 88 is activated whenever the drive rollers 68 and 70 operate. When the rollers stop (during the cutting operation), the air tube 88 is shut off.

The drive rollers 68 and 70 are both driven by a permanent magnet motor 102 carried on the frame member 54 as shown in FIG. 2. The motor 102 has a belt drive connection to a gear reducer 103. The gear reducer in turn is connected by a chain belt 105 to gears carried by the shafts of rollers 68 and 70. To stop the drive rollers 68 and 70 the field of the permanent magnet drive motor 102 is shorted out, which causes that motor to stop instantaneously, and that in turn causes the drive rollers to come to a "dead stop".

In FIGS. 4 and 4A the cutter is shown to include fixed block 82 mounted on an angle 110 welded to cross member 112 extending between the sides of the frame. The block 82 carries a ceramic pad 114 in which the hot wire 116 is embedded. The upper block 84 is carried on the piston rods 118 of air cylinders 120 mounted on each side of the frame by means of plate 122 and angle 124. The block 84 carries on its bottom surface the top ceramic pad 126, which has a recess 128 in its lower surface facing hot wire 116. The lower surface 127 of the top ceramic pad 126 engages the upper surface 129 of the lower pad 114 when the piston 120 moves the block 84 to the cutting position shown in FIG. 4A. The margins of the cavity 128 in upper pad 126 grab the sheet material as suggested in FIG. 4A, and the material itself is melted within the cavity. The same melting operation causes the ends of the material on each side of the cut to fuse together to prevent unraveling. When the cutter is closed as shown in FIG. 4A, the material is prevented from moving. That is, the material forward of the cutter on the folder approach belt 100 which is continuously running, remains in place, In FIG. 3 the block 82 is shown supported on a number of pads 130 on the horizontal flange of angle 110. The block 84 is maintained in alignment with the block 82 by the posts 134 and bushings 136.

The wire 116 is 0.030 inch nickel chromium wire which is tensioned at each end by a spring assembly 140. Both are shown in FIG. 3 and one is herein described. The assembly includes a wire anchor bracket 142 mounted on an insulation block 144 in turn carried on the end of the block 82. The wire 116 which sits in a trough in the upper surface of the ceramic pad 114 extends through a first hole 146 in the arm 148 and proceeds through a second hole 150 slightly off center with respect to the hole 146, and then ties to the spring 152. Because the holes 146 and 150 are not aligned, and further because the hole 146 is inclined downwardly in the direction of the hole 150, the wire is kept firmly against the margins of the hole 146 so as to make good electrical contact with the bracket 142. The bracket in turn is connected to the electrical lead 154 by means of a screw terminal 156. Thus, the power is provided the wire by means of its contact with the aluminum bracket 142. The springs 152 are required at each end of the hot wire because of the substantial changes of length of the wire when the wire is heated. For example, with a 90 inch wire, the length may increase in excess of 2 inches during heating.

FOLDER ASSEMBLY

The folder approach belt 100 is carried by idle roller 150 and driven roller 152. The belt 100 is made up of a number of separate, parallel narrow belts, and the sheet material is held on the belt 100 by means of the blow pipes 154 disposed above it. The belt 100 is continuously driven by its drive roller 152.

It is important that air be used to retain the sheet material on the belts so as to avoid the generation of any static electricity. If the sheet material carries static electricity, it will not hang down in the position suggested by the broken lines S in FIG. 5 before being subjected to the folding operation but rather will adhere to the transfer belts so as to prevent proper folding of the cut sheets.

Figure 5A:
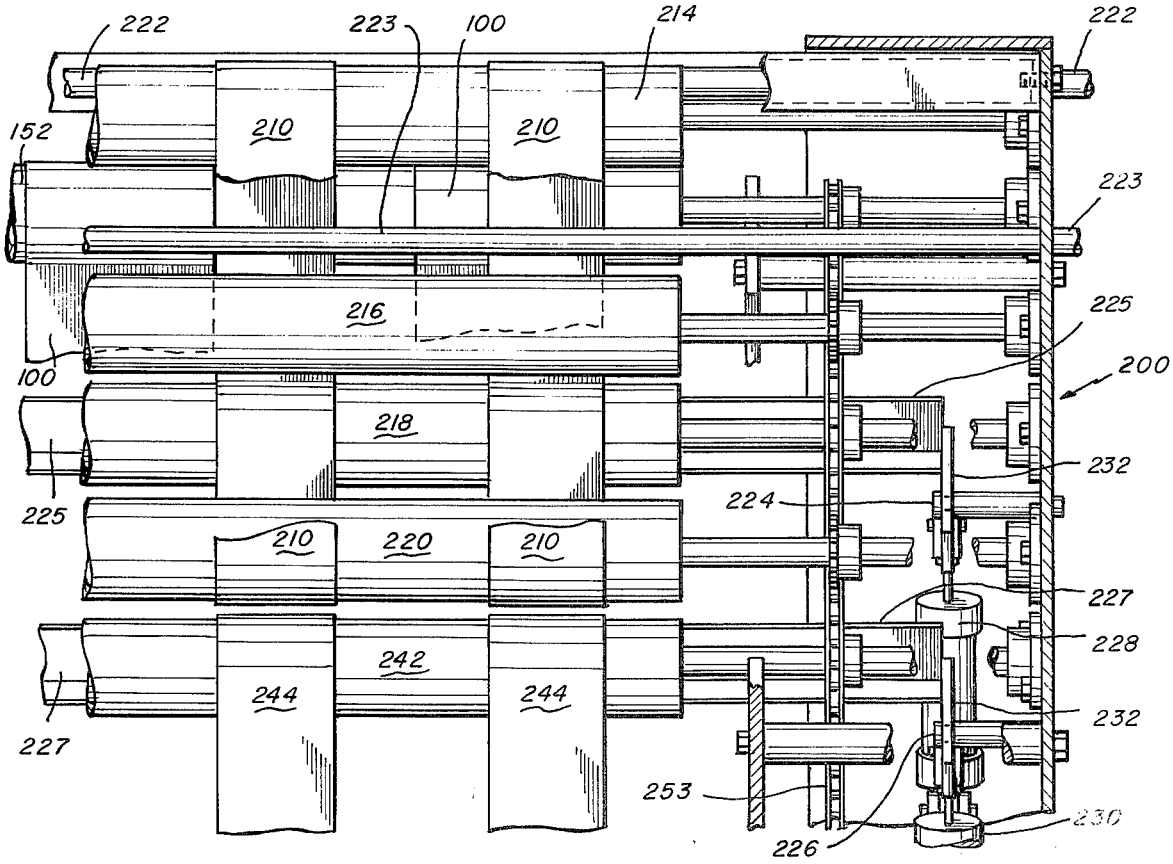
FIG. 5A is fragmentary rear elevation view of the folder assembly taken along sight line 5A—5A of FIG. 5.
Figure 5:
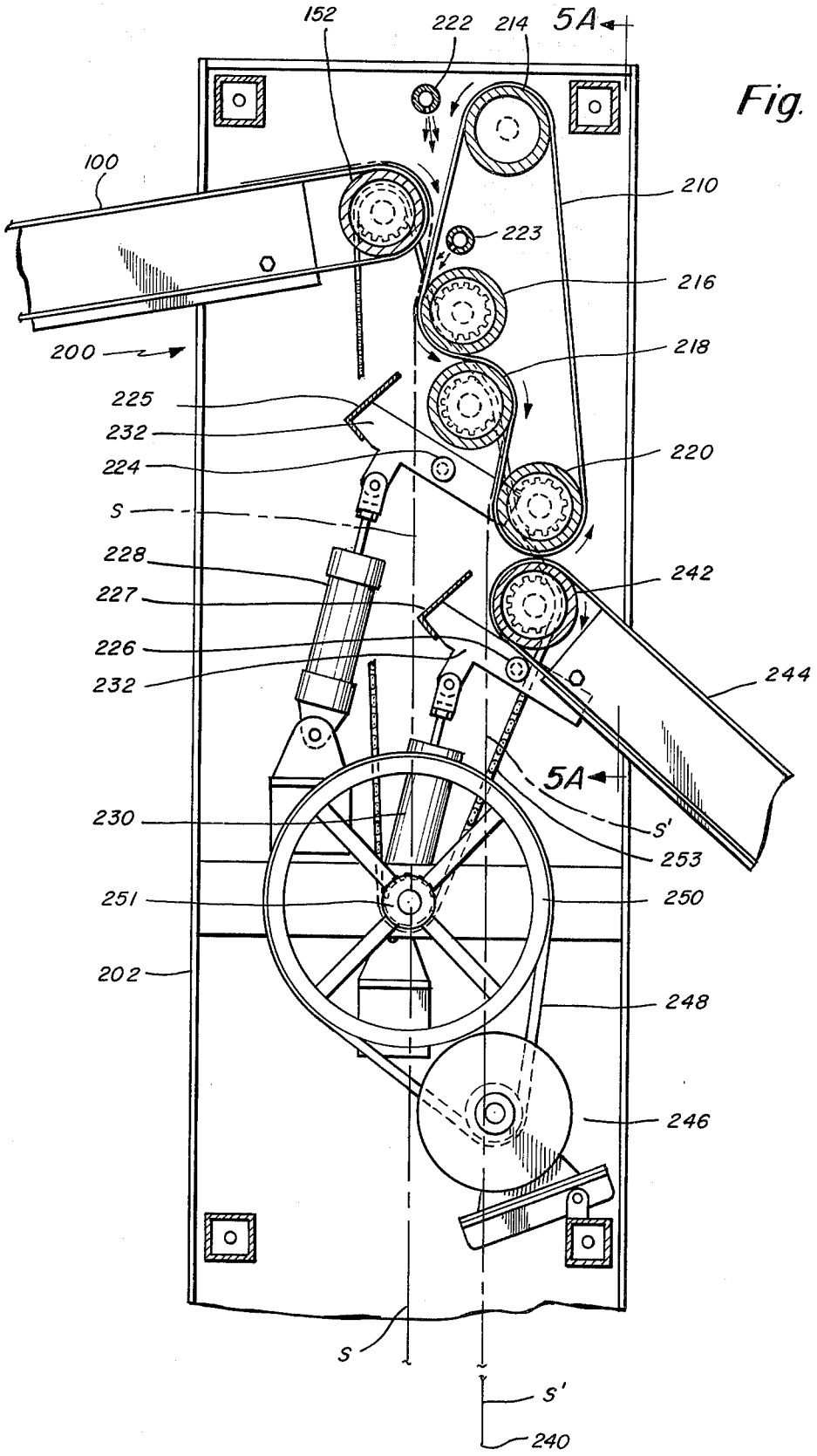
FIG. 5 is a fragmentary side elevation view of the folder assembly.

In FIGS. 5 and 5A, the folding operation is shown conducted on as assembly 200 mounted on side frame member 202 in turn supported above the floor by a base 204, The sheet material is suggested at S in FIG. 5 extending downwardly from the drive roller 152. The folding transfer belt 210 extends about a series of rollers 214, 216, 218 and 220. One air pipe 222 is shown disposed slightly above the drive roller 152 and in front of the roller 214 and a second air pipe 223 is positioned between the rollers 152 and 216 to insure that the leading edge of the sheet material as it leaves the drive roller 152 and the transfer belt initially hangs down in the position suggested by broken lines S.

Typically the sheets are cut to 120 inch lengths, and the folding assembly of FIG. 5 is designed to fold the length of material in quarters. When the material is hanging down from the drive roller 152 in the position suggested at S, the fold blades 225 and 227 are pivoted to the left, as shown, about their respective pivotal supports 224 and 226 by means of the cylinders 228 and 230. The fold blades are each carried by arms 232 on each side of the machine, and the blades extend across the machine in the manner suggested.

The first fold in the example given will be made at the 60 inch line of the material and is formed by the rollers 216 and 218 along with fold blade 225. When the sensing assembly or timing unit (not shown) determines that the 60 inch line of material is opposite the position between the rollers 216 and 218, the cylinders 228 are actuated so that the blade 225 pushes the sheet material at the 60 inch line between the rollers 216 and 218 and underneath the belt 210. The folded leading edge of the material is then carried about the roller 218 underneath belt 210, and the folded material once again hangs downwardly in the position suggested by broken line S'. The folded edge of the material will lie at the bottom of the hanging sheet. Once again the material length is measured, this time in the example given to 30 inches, and the cylinders 230 are actuated to move the blade 227 to the right and drive the center line of the once folded sheet between the rollers 220 and 242 to form the second fold. Roller 242 supports the upper end of the stacker delivery belt 244, and the twice folded sheet is deposited on that belt after passing between the rollers, with the fold formed by the blade 227 as the leading edge of the package which comprises the twice folded sheet.

In FIG. 5 a second permanent magnet motor 246 is shown mounted on the frame, which through a pulley belt 248 drives pulley 250 that in turn carries gear 251 and chain 253 which drive the rollers 152, 216, 218, 220 and 242, all of which carry their own gears on their shafts and about which the chain 253 snakes.

TRANSFER AND STACKER ASSEMBLY

In FIGS. 1, 2, 6 and 7 the transfer stacker assembly 270 is shown. The assembly is designed to carry the folded pieces from the stacker delivery belt 244 to the belt conveyor 272 carried on the scissor lift 274. The stacker delivery belt 244 includes a number of narrow, parallel belts that extend between the drive roller 242 and the idle roller 276. As the package which comprises the cut and quarter folded sheet proceeds down the stacker delivery belt which is continuously driven by the drive roller 242, the package reaches a position wherein it overlies the separate fingers 280 of the transfer assembly. The assembly is actuated by the finger 282 (see FIG. 7) which extends upwardly between the narrow belts of the stacker delivery belt and is engaged by the leading edge of the package.

The transfer assembly includes a shaft 284 supported on and extending between the side frame members 286. The side frame members carry arms 288 that directly support the shaft 284. The shaft in turn carries an angle member 290 that in turn carries a number of mounting brackets 292 each bearing one finger 280. The fingers as stated are disposed between the individual belts of the stacker delivery belt 244. Sprockets 294 are mounted on shaft 284 and are operated by chain 296 whose opposite ends are connected to the piston rods 298 and 300 of cylinders 302 and 304, respectively.

Figure 6:
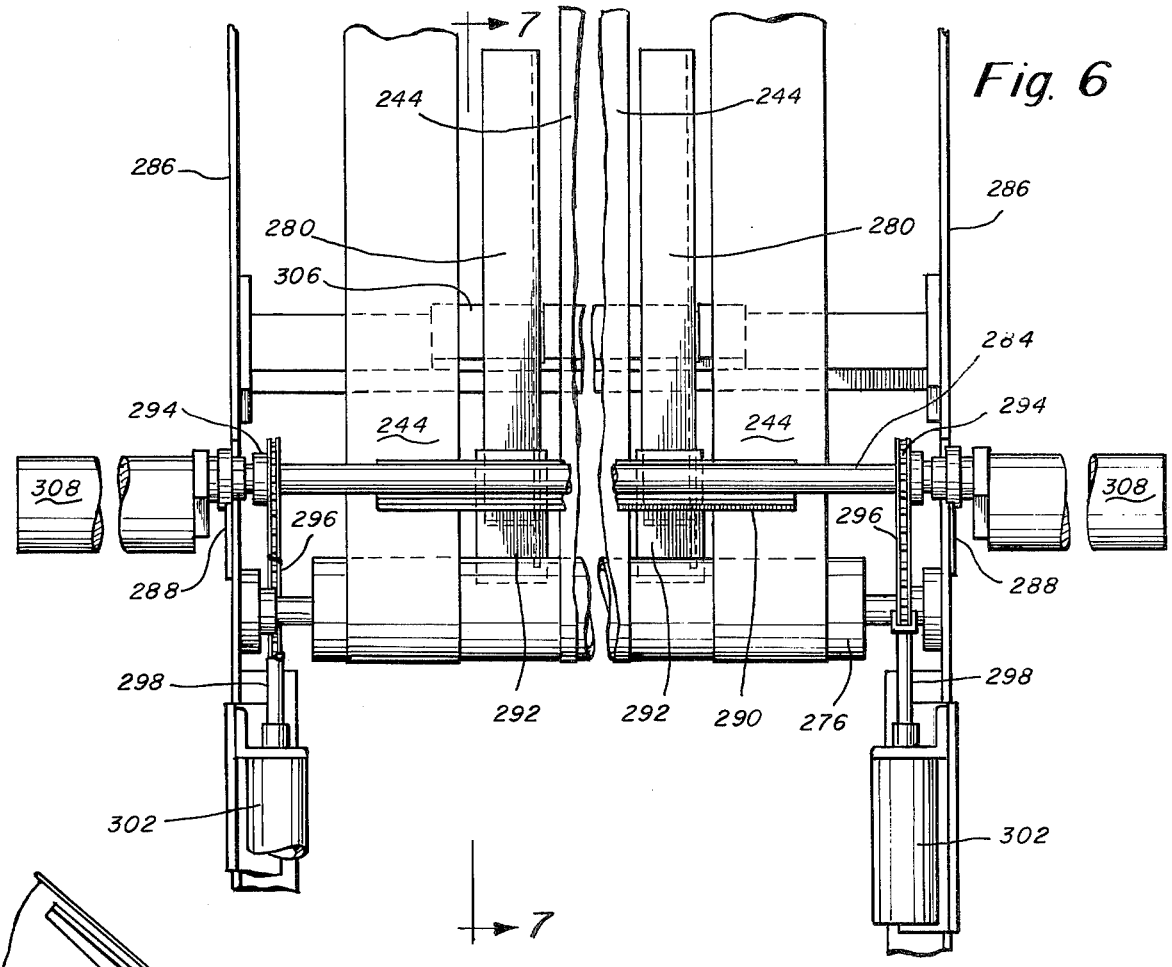
FIG. 6 is a fragmentary rear elevation view of the transfer and stacker assembly as viewed along sight line 6—6 of FIG. 2.
Figure 7:
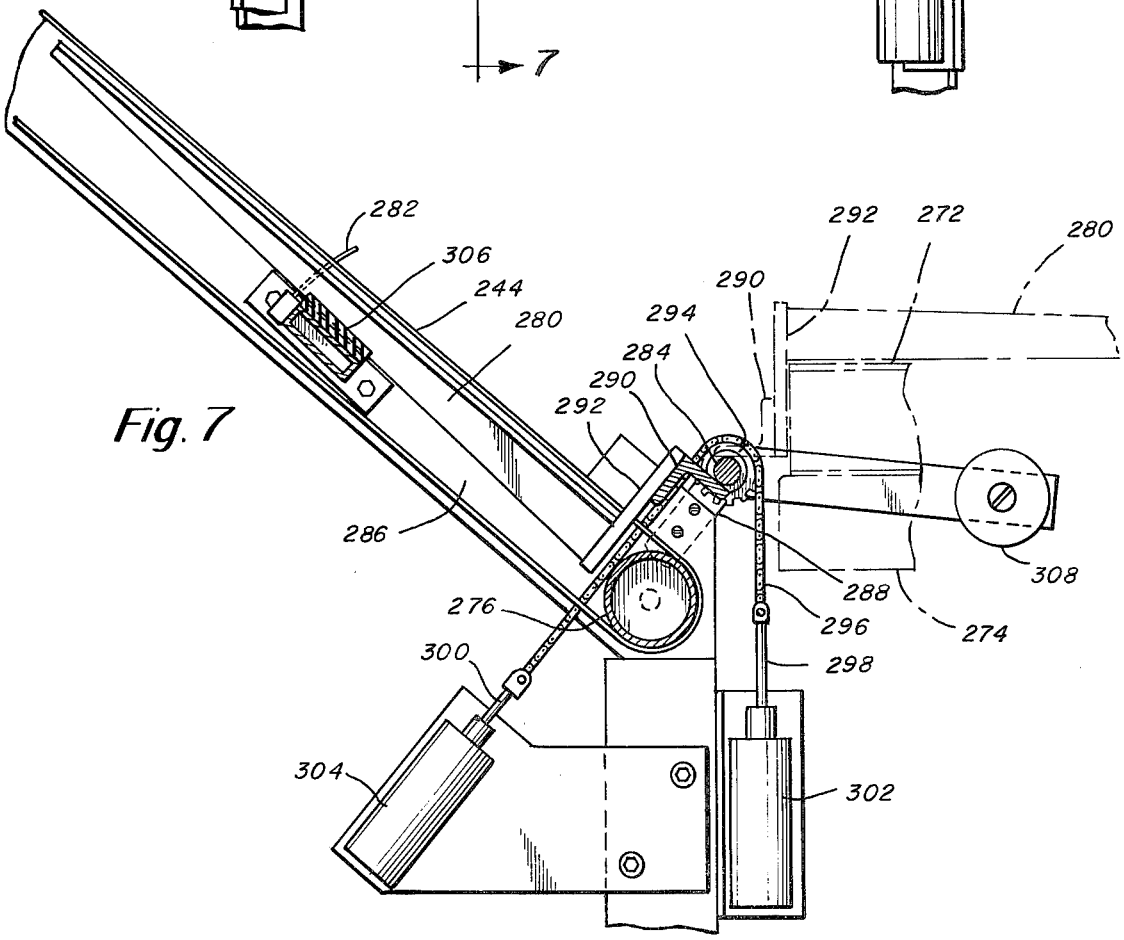
FIG. 7 is a cross-sectional view of the transfer and stacker assembly taken along section line 7—7 of FIG. 6.

In the rest position, the fingers 280 are supported on the pad 306 which is mounted on the frame member 286. The stacker shaft 284 carries counterbalance weights 308 as shown in FIG. 6 to reduce the load on the cylinders 302 and 304 which actuate the stacker.

When the leading edge of the folded sheet package engages the finger 282 the appropriate control valves (not shown) are open to direct air under pressure to the proper sides of the cylinders 302 and 304. The time delay created by the time required for actuation of the cylinders allows the package to fully overlie the fingers 280. Then, upon actuation of the shaft 284 by chains 296, the fingers flip over to assume a position shown in FIG. 7 in broken lines wherein they precisely overlie the conveyor 272, with the plate 292 tight against the side of the conveyor. The fingers 280 serve to compress the articles on the belt conveyor 272. A counter (not shown) is associated with the actuation of the stacker and may record 10 or some other number of cycles of the stacker. When the selected number of cycles have occurred, a control associated with the scissor lift 274 lowers the upper surface of the lift along with the conveyor 272 to provide room for an additional stack of packages. After a selected number of packages are placed on the conveyor and the scissors lift is lowered to a selected height (perhaps 20 inches), the conveyor 272 is actuated to transport the stack of articles to the next station.

TRANSFER AND BUNDLING STATIONS

In FIG. 1 the transfer station is identified at 350. The station 350 comprises a pivoted roller conveyor 352 anchored by its pivot post 354, which enables the conveyor to be turned 90° from the position in alignment with the conveyor 272 as shown in full lines in FIG. 1 to the position shown in broken lines and identified as 350A in FIG. 1. The pivoting of the conveyor 350 may be carried out manually by an operator and is assisted by the casters 356 that support the conveyor 352.

The stack of packages which comprise a bundle is suggested by broken line rectangle B in FIG. 1. The operator manually drags the bundle B on its cardboard base (normally placed on conveyor 272 and onto which the folded sheets are stacked by stacker assembly 270) from the conveyor positioned at 350A so that a portion overlies the power strapping machine represented diagrammatically by box 360 in FIG. 1. That machine which forms no part of the present invention will apply several bands about the bundle as the operator manually moves the bundle over the strapping machine. Thereafter the strapped bundle is manually moved to the tilt conveyor 370 and from there it is slipped onto the multibundle conveyor 400 where several bundles may be strapped together.

OPERATION

The roll of sheet material R, which may be approximately 90 inches in width, is placed on the cradle 12 and is threaded about rollers 18, 20, 22 and 24 and fed between the pinched rollers 26 which are continuously driven by a motor (not shown). The sheet material is continuously drawn from the roll R by virtue of the fact that the pinch rollers 26 are continuously driven. Therefore, there is no stopping and starting of roll rotation which would place a considerable strain on the motor driving the pinch rollers and otherwise tend to upset the alignment of the machine. The printer 28 mounted on the top of extensions 36 is adapted to apply the desired indicia to the sheet material as it passes about the roller 20.

The bin 42 of the scray temporarily collects the sheet material unwound from the roll R before it is fed about rollers 58, 60, 62, 64 and 66 and is fed to the hot wire cutter 80 by means of the pinch rollers 68 and 70. The driven roller 68 of the pinched rollers is operated intermittently by its motor 102, and consequently the scray is required to temporarily collect lengths of the sheet unwound from the roll R before it is fed by the pinch rollers 68 and 70 to the cutter.

The hot wire cutter severs the continuous sheet into sheet sections of a selected length, perhaps 60 inches, and the nature of the hot wire cutter also serves to seal the margins of each cut. As the sheet material is made of a synthetic substance, the hot wire will melt the filaments and cause them to fuse so that they will not unravel.

From the cutter assembly 50 the sheets are carried by the belt 100 to the folder assembly where, in the manner described in detail above, the sheet is first folded in half and then is folded in quarters. Thereafter the quarter folded sheet is deposited onto the transfer conveyor 244.

The conveyor 244 which is continuously operating by virtue of the continuous running of motor 246 carries the folded sheets onto the fingers of the stackers assembly 270. Upon actuation of the stacker assembly the fingers rotate over their shaft 284 and are pressed down upon the transverse conveyor 272 carried on the scissor lift 274. The scissor lift may be lowered intermittently to enable the fingers to reach the horizontal position shown in broken lines in FIG. 7 so that they may firmly press the articles down on the bundle. From the conveyor 272 the articles are fed onto the roll conveyor 352, and from there they are carried to the strapping machine. From the strapping machine the bundles may be transported to the tilt conveyor 370 and from there onto the multi-bundle conveyor where the several bundles may be strapped together.

Having described this invention in detail those skilled in the art will appreciate that numerous modifications may be made of this invention without departing from its spirit. Therefore, it is not intended that the breadth of this invention be limited to the specific embodiment illustrated and described. Rather, its scope is to be determined by the appended claims and their equivalents.

What is claimed is:

1. A sheet cutting, folding and stacking machine comprising a cradle for supporting a roll of sheet material to be processed on the machine, means for feeding the sheet material from a roll on the cradle to a cutting station, a cutter including a hot wire forming part of the machine for cutting sheets of selected size from the roll, a folder approach conveyor disposed adjacent the cutter station for receiving the cut sheet one at a time from the cutting station, a folder mounted immediately adjacent the approach conveyor for receiving the sheets to be folded, means including a pair of rollers and a blade forming part of the folder for making at least one fold in each sheet after its leaves the approach conveyor, a transfer conveyor mounted adjacent the folder for receiving the folded sheets from the folder, a stacker assembly mounted on the transfer conveyor in the path of folded sheets received by said conveyor for removing the folded sheets from the transfer conveyor, said cradle including a plurality of idler rollers forming a bed to support the roll of sheet material, driver rollers for engaging the sheet for pulling the sheet from the roll, and a scray disposed between the wire cutter and drive rollers for temporarily collecting lengths of the sheet material prior to it being fed to the cutter.

2. A sheet cutting, folding and stacking machine as described in claim 1 further characterized by an elevatable table disposed adjacent the stacking assembly, and said stacker assembly including a plurality of fingers disposed immediately adjacent the transfer conveyor, and means connected to said fingers causing them to lift folded sheets from the transfer conveyor and turn them over and on top of the table.

3. A sheet cutting, folding and stacking machine as described in claim 1 further characterized by a printer disposed on the machine between the cradle and the drive rollers for printing indicia on the sheet.

4. A sheet cutting, folding and stacking machine as described in claim 1 further characterized by said hot wire cutter including a pair of non-conducting pads movable toward and away from one another, an electrically conductive wire carried by one of the pads and a cavity in the other of the pads to receive the wire when the pads are moved into a position to engage one another with the sheet material lying in the cavity in contact with the wire, tensioning means connected to the wire for compensating for elongation of the wire when it is heated, and means for automatically moving the pads into engagement with one another to cut the sheet.

5. A sheet cutting, folding and stacking machine as described in claim 4 further characterized by said folder including two pairs of rollers generally vertically aligned with one another, an endless belt snaked about some of the rollers, a blade mounted on the frame adjacent one pair of said rollers, means for actuating said blade to form a fold in said sheet and push said fold between the pair of rollers and beneath the belt to complete one fold of the sheet, a second blade mounted on the frame and cooperating with the second pair of rollers, and actuating means for the second blade to form a second fold in said once folded sheet and push the fold between the second pair of rollers to complete the second fold in said sheet.

6. A sheet cutting, folding and stacking machine as described in claim 1 further characterized by said folder including two pairs of rollers whose axes are generally parallel with one another, an endless belt snaked about some of the rollers, a blade forming part of the folder and adjacent one pair of said rollers, means for acutating said blade to form a fold in said sheet and push said fold between the pair of rollers and beneath the belt to complete one fold of the sheet, a second blade mounted on the frame and cooperating with the second pair of rollers, and actuating means for the second blade to form a second fold in said once folded sheet and push the fold between the second pair of rollers to complete the second fold in said sheet.

7. A sheet cutting, folding and stacking machine as described in claim 6 further characterized by an elevatable table disposed adjacent the stacking assembly, and said stacker assembly including a plurality of fingers disposed immediately adjacent the transfer conveyor, and means connected to said fingers causing them to lift folded sheets from the transfer conveyor and turn them over and on top of the table.

8. A sheet cutting, folding and stacking machine as described in claim 6 further characterized by said transfer conveyor including a plurality of spaced, narrow, parallel belts, a plurality of fingers disposed between the parallel belts, a shaft supporting said fingers for pivotal motion about the shaft axis, and means for actuating said shaft to cause the fingers to lift a sheet off said belts and stack them at another location.

9. A sheet cutting, folding and stacking machine as described in claim 1 further characterized by said transfer conveyor including a plurality of spaced, narrow, parallel belts, a plurality of fingers disposed between the parallel belts, a shaft supporting said fingers for pivotal motion about the shaft axis, and means for actuating said shaft to cause the fingers to lift a sheet off said belts and stack them at another location.

* * * * *